US005484081A

United States Patent [19]

Jahn

[11] Patent Number: 5,484,081

[45] Date of Patent: Jan. 16, 1996

[54] RELEASABLE SUCTION HANDLE FOR BEVERAGE CONTAINERS

[76] Inventor: Todd C. H. Jahn, 38 W. Hygeia Ave., Hampton, Va. 23663

[21] Appl. No.: 289,188

[22] Filed: Aug. 11, 1994

[51] Int. Cl.[6] ..... B65D 25/28

[52] U.S. Cl. ..... 220/759; 220/756; 220/740; 220/741; 220/483

[58] Field of Search ..... 16/114 R, 111 R; 294/64.1, 27.1; 220/756, 740, 483, 737, 741, 759

[56] References Cited

U.S. PATENT DOCUMENTS

| | | | |
|---|---|---|---|
| D. 265,279 | 7/1982 | Wright . | |
| 2,131,687 | 9/1938 | Kaplan | 16/114 R |
| 3,084,764 | 4/1963 | Duffey et al. | 220/483 |
| 3,719,305 | 3/1973 | Pressnell | 220/740 |
| 3,720,433 | 3/1973 | Rosfelder | 294/64.1 |
| 4,230,235 | 2/1980 | DiAmico . | |
| 4,602,723 | 7/1986 | Demars . | |
| 4,898,297 | 2/1990 | Wheeler . | |
| 4,932,701 | 6/1990 | Cornillier et al. | 294/64.1 |
| 5,054,638 | 10/1991 | Rose . | |
| 5,203,471 | 4/1993 | Widman | 220/756 |

FOREIGN PATENT DOCUMENTS

| | | | |
|---|---|---|---|
| 1044878 | 11/1953 | France | 220/483 |
| 347955 | 7/1960 | Switzerland | 16/114 R |

*Primary Examiner*—Stephen J. Castellano
*Attorney, Agent, or Firm*—Wallace J. Nelson

[57] ABSTRACT

A portable handle for a beverage container wherein a hand graspable handle portion is releasably attached to a beverage container by suction cups. In one aspect of the invention an essentially C-shaped handle is provided with a suction cup at each end thereof to engage and attach to secure a beverage can. In another aspect of the invention, an elongated support shaft is provided integral with the hand graspable portion and one or more suction cups are linearly secured to the elongated support shaft. In another aspect of the invention bifurcated ends of the hand graspable handle have can engaging suction cups secured to the individual biased surfaced ends of each prong. The bifurcated prongs may be parallel to each other, or canted to provide more space therebetween and to position the attached suction cups in an essentially diametric opposed position about the circumference of the beverage can. In each of the embodiments, an additional suction cup may be slidably secured thereto to provide an adjustable attachment for the handle and attached beverage can to permit stabilizing of the hand graspable handle to a solid surface.

5 Claims, 2 Drawing Sheets

RELEASABLE SUCTION HANDLE FOR BEVERAGE CONTAINERS

FIELD OF THE INVENTION

This invention relates generally to container handles and relates specifically to releasable, suction attached, handles for beverage containers.

BACKGROUND OF THE INVENTION

Portable handles for metal beverage cans are well known in the prior art as exemplified by U.S. Pat. No. 5,054,638 to Rose; U.S. Pat. No. 4,898,297 to Wheeler; U.S. Pat. No. 4,602,723 to DeMars; and Des. U.S. Pat. No. 265,279 to Wright. Each of these prior art devices provide releasable attachments to the top and bottom of the beverage containers or to fixed structure on the can side. Some of these prior art devices also have added features such as an attached key ring (Rose), a unitary coaster (Wheeler) and tab receiving structure (DeMars). U.S. Pat. No. 4,230,235 to Di Amico employs a structure riveted to the can side wall with folded sections forming the handle for the beverage container.

Portable handles for beverage cans provide the advantages of avoiding unnecessary contact of warm hands on wet and cold beverage containers and of providing a convenient support for handling the individual containers when drinking therefrom. Further there is less likelihood of dropping and spilling of the contents of a cold, wet container, when a separate handle is employed while consuming the beverage. The present invention employs some of the advantageous features of the prior art devices while minimizing some of the disadvantages thereof.

Accordingly, it is an object of the present invention to provide an improved releasable, suction attachable, handle for beverage containers.

Another object of the present invention is to provide a handle for beverage containers that is simple to use, of lightweight construction and provides reliable and positive, releasable, attachment structure.

Another object of the present invention is to provide a novel handle and lid arrangement for beverage containers.

SUMMARY OF THE INVENTION

According to the present invention the foregoing and additional objects are attained by providing a portable handle for converting a beverage container into a drinking mug wherein a hand graspable handle portion is releasably attached to a beverage container by one or more suction-cup devices. In one aspect of the invention an essentially C-shaped handle is provided with a suction cup device at each end thereof to engage and secure a beverage can thereto. In another aspect of the invention, an elongated support shaft is provided integral with the hand graspable handle and one or more suction cups are secured to the elongated support for engagement with a beverage can. In another aspect of the invention the ends of the hand graspable handle are provided with bifurcated extensions with a can engaging suction cup being secured to biased surfaces provided on the end of each of the bifurcated prongs. The bifurcated prongs may be parallel to each other or canted to provide more space therebetween and to position the attached suction cups essentially diametrically opposed about the circumference of the beverage can.

In each of the described handles, an additional suction cup may be slidably secured thereto to provide an adjustable attachment to permit stabilizing the hand graspable handle to a table top, wall, or bulkhead, as so desired.

BRIEF DESCRIPTION OF THE DRAWINGS

A more complete appreciation of the invention and many of the attendant advantages thereof will be better understood when considered in connection with the accompanying drawings wherein.

DETAILED DESCRIPTION

Figure 1:
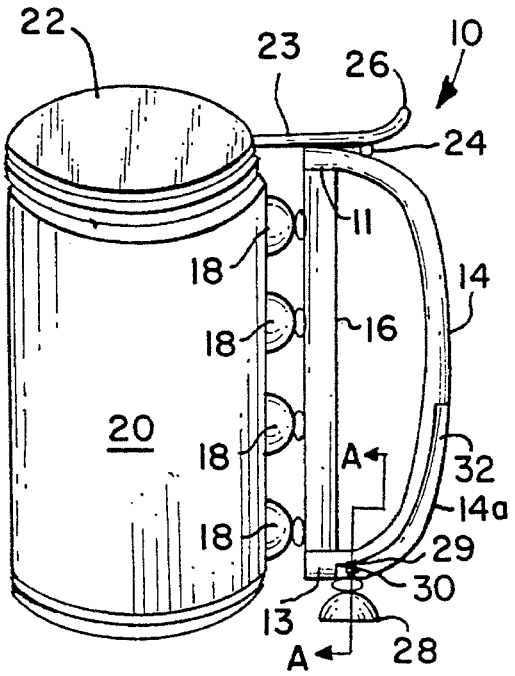
FIG. 1 is a schematic side view of a portable releasable handle for a beverage container according to one aspect of the present invention.
Figure 2:
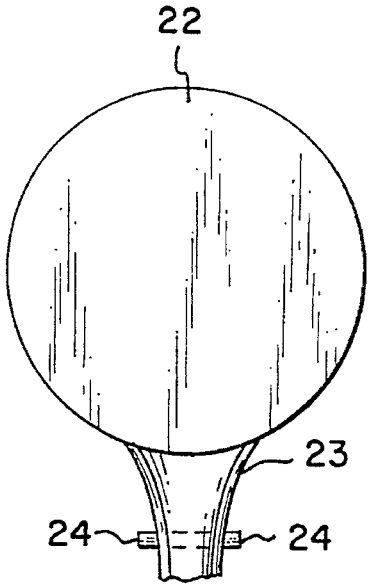
FIG. 2 is a schematic top view of the portable releasable handle and lid shown in FIG. 1.
Figure 1A:
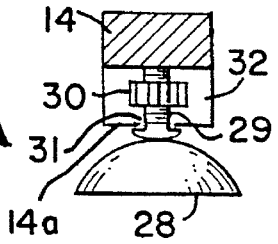
FIG. 1A is a sectional view taken along line A—A of FIG. 1.

Referring now to the drawings, and more particularly to FIGS. 1, 1A and 2, the preferred embodiment of the releasable handle of the present invention is illustrated and designated by reference numeral 10. Handle 10 includes a pair of spaced end portions 11 and 13 having an intermediate hand graspable portion 14 disposed therebetween. An elongated support shaft 16 integrally extends substantially perpendicular between said pair of spaced end portions. A plurality of suction cups 18 are disposed along the length of elongated support shaft 16 and serve to contact and to releasably engage the surface of a beverage can 20.

A pivotal lid 22, having an integral extension 23 thereon is connected, via pivot pin 24, to the top surface of end portion 11 of handle 10. A stein style thumb holder 26 is provided on the end of lid extension 23 in position for contact with the thumb of a user of handle 10 to permit raising and lowering of lid 22, as desired.

An additional suction cup 28 is slidably secured to a surface of hand grasping portion 14 of handle 10. Suction cup 28 is provided with a threaded bolt connection 29 extending through a threaded nut 30 and engaging an inner portion of hand grasping portion 14. Threaded nut 30 is slidably received in a conventional manner within a groove 32 extending from end portion 13, over a substantial length of the hand graspable portion 14 of handle 10. As shown more clearly in FIG. 1A, groove 23 extends completely through hand grasping portion 14 of handle 10 leaving a thin section of portion 14 (not designated) to receive threaded bolt connection 29 therethrough. A slit (not designated) extends along the length of this thin section of hand graspable portion 14 for slidably receiving threaded bolt connection 29 therethrough while retaining nut 30 within groove 32. Rotation of suction cup 28 in the clockwise direction causes threaded bolt connection 29 to frictionally engage the base of groove 32 and retain suction cup 28 in position. Rotation of suction cup 28 in the counterclockwise direction reduces the friction contact of threaded bolt connection 29 and permits movement of suction cup 29 and attached slidable nut 30 along groove 32 to the desired location. When suction cup 28 is retained in a specific position along groove 32 it may be employed to fixedly and releasably secure handle 10, and any attached beverage container 20, to any solid surface. These solid surfaces may include, but are not limited to, table tops, automobile side windows, ship bulkheads, and the like.

Figure 3:
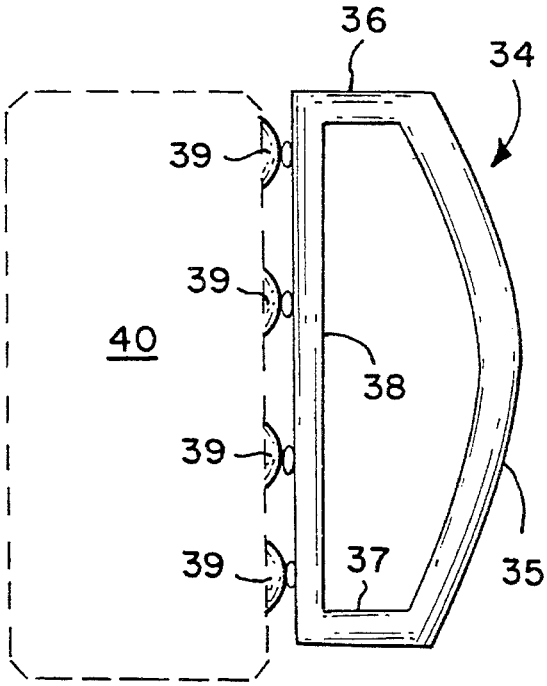
FIG. 3 is a schematic view showing a modified form of the handle shown in FIG. 1 omitting the lid and adjustable attachment structure.

Referring now to FIG. 3, a modified releasable, suction attached, handle for a beverage container is shown and designated generally by reference numeral 34. Handle 35 includes a curved hand graspable portion 35 that terminates in a pair of parallel ends 36, 37. An elongated support shaft 38 is integrally secured to the respective ends 36,37 and is provided with a plurality of suction cups 39 fixedly attached thereto. Suction cups 39 serve to releasably attach handle 34 to a beverage container 40.

Figure 5:
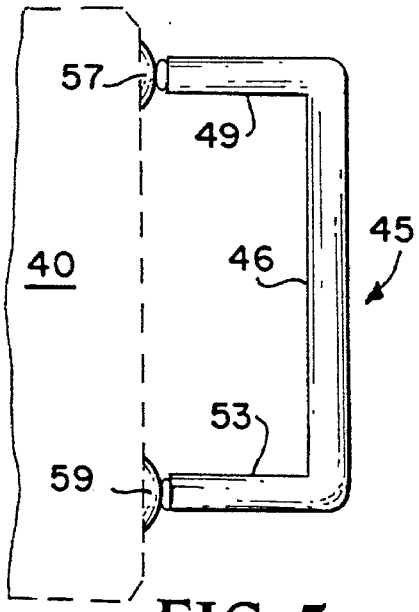
FIG. 5 is a schematic side view of the beverage can handle shown in FIG. 4.
Figure 4:
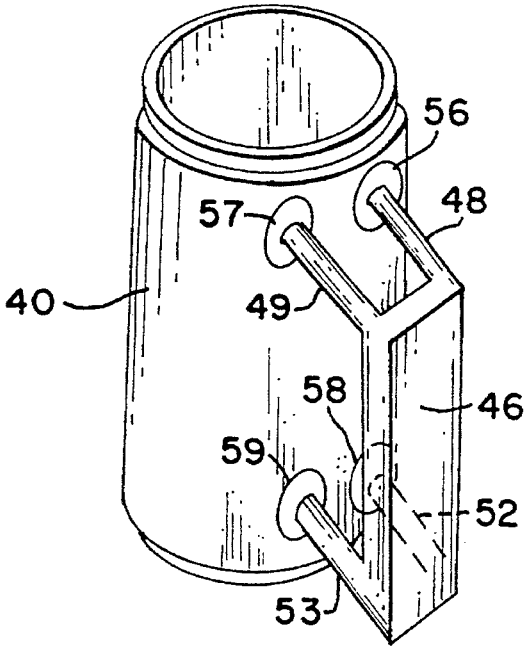
FIG. 4 is a schematic perspective view of another modified beverage can handle according to the present invention.
Figure 6:
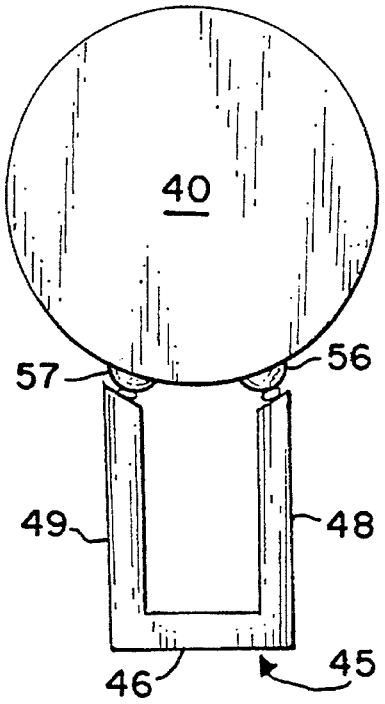
FIG. 6 is a schematic top view of the beverage can handle shown in FIGS. 4 and 5.

Referring to FIGS. 4–6, another modified releasable, suction attached, handle for beverage container 40 is shown and designated generally by reference numeral 45. Handle 45 is provided with a hand graspable portion 46 that terminates in a pair of integral bifurcated end segments. The individual prongs of the bifurcated ends are disposed in parallel pairs and designated by respective reference numerals 48,49 and 52,53. Each of prongs 48,49 and 52,53 is provided with a slant or angular cut end (not designated) having individual, suction cups secured thereto, as designated by respective reference numerals 56,57 and 58,59. The laterally spaced suction cups 56,57 engage beverage container 40 adjacent the top thereof while suction cups 58,59 engage spaced portions of beverage container 40 adjacent the bottom thereof.

Figure 7:
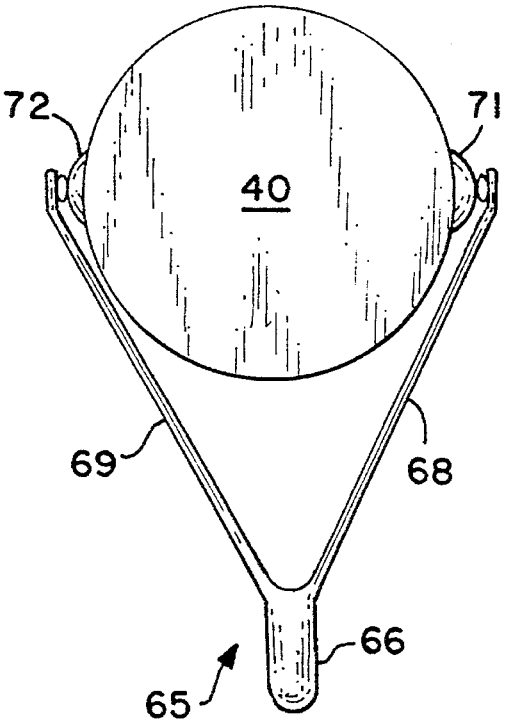
FIG. 7 is a schematic top view of another modified beverage can handle similar to that shown in FIGS. 4–6.

Referring to FIG. 7, a top view of another modification of the releasable, suction attached, handle for beverage containers, according to the present invention, is shown and designated generally by reference numeral 65. Only the top of handle 65 and its component parts are shown in the drawing in the interest of brevity, it being understood that the bottom structure and function of handle 65 is identical to the top portion shown. Handle 65 is also provided with a hand graspable portion 66 that terminates in a pair of bifurcated end segments, the top member of which is illustrated in this FIG.

The individual prongs of the bifurcated ends are canted or angularly disposed relative to each other to provide a substantially V-shaped opening therebetween as illustrated with the top prongs being designated by reference numerals 68,69. The tip ends of prongs 68,69 (and those of the bottom prongs, not shown), are provided with a slant, or angular cut ends (substantially forty-five degrees with respect to the horizontal and not designated), having respective, individual, suction cups 71,72 secured thereto. Suction cups 71,72 contact beverage container 40 such that they are essentially diametrically about the circumference of beverage container 40 to provide increased stability for handle 65.

Figure 8:
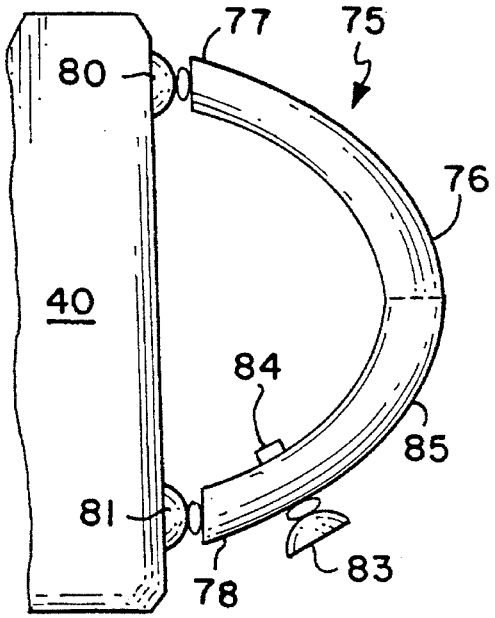
FIG. 8 is a schematic side view of another modified beverage can handle according to the present invention.

Referring now to FIG. 8, a side view of another modified and simplified releasable, suction attached, handle for beverage containers is shown and designated generally by reference numeral 75. In this embodiment, a hand graspable handle portion 76 is provided with essentially parallel terminal ends 77,78 having substantially square tips, not designated. Each of the square tips of terminal ends 77,78 is provided with an attached suction cup as designated, respectively, by reference numerals 80, 81. Suction cups 80,81 serve to engage beverage container 40 at an area adjacent the respective bottom and top portions to thereby convert beverage container 40 into a equivalent drinking "mug".

An alternate form of an adjustable suction cup 83 is employed with handle 75 to permit releasable attachment of the handle to a solid surface such as a table top, automobile window glass, boat bulkhead, or the like. Adjustable suction cup 83 is provided with an adjustment turn screw 84 slidably received through groove 85 provided along a portion of the length of hand graspable portion 76. When the knurled head of turn screw 84 is tightened against the inner surface of hand graspable handle portion 76, adjustable suction cup 83 is frictionally retained at that position along the length of terminal end 77 and hand graspable handle portion 76. Upon loosening of turn screw 84, it and the attached adjustable suction cup 83, may be moved to any point along the length of groove 85 and frictionally locked at that point by again tightening of turn screw 84.

From the foregoing, it is readily seen that the present invention provides a new and novel, suction attached, portable handle for converting beverage cans into appropriate drink "mugs". The suction cup attachments are facilitated by the wet surfaces encountered by refrigerated or iced beverage containers and permit the user to avoid hand contact with the cold beverage containers thereby avoiding unnecessary body warming of the container contents while also minimizing contact with the wet containers.

In use, the handle is positioned along the side of a beverage can to align the suction cups vertically against the can. By firmly pressing the suction cups against the can, a secure attachment is attained and the handle may then be used to lift and drink from the converted can "mug". For removal, the suction cups are forcefully pulled away from the can to release the handle.

No specific materials have been mentioned for manufacture of the present invention, it being understood that any conventional material, having the desired physical strength property characteristics necessary to perform the intended results, is considered applicable for practice of the invention. These materials include, but are not limited to, lightweight metals, metal alloys, plastics and composites, that may be machined, stamped, molded or otherwise formed to the desired shapes.

Also, the specific embodiments shown and described herein are intended to be exemplary and are not to be deemed as exhaustive. For example, the embodiments shown and described are for standard twelve ounce cans and employ four, one-half inch, suction cups. The invention is equally applicable for sixteen ounce, or larger or smaller, beverage cans and the number and size of the suction cups employed may vary, without departing from the teaching of the invention. In some application, a single large suction cup may be employed while in others, it may be desirable to employ two, three, four or more suction cups of smaller or larger size than that employed in the specific examples described herein.

Thus, although the invention has been described relative to specific embodiments thereof, it is not so limited and there are numerous variations and modifications of the invention that will be readily apparent to those skilled in the art in the light of the above teachings. For example, although the adjustable suction cups are illustrated on only some of the specific embodiments described herein, it is to be understood that these adjustment fastening devices may be employed on any of the embodiments without departing from the spirit and scope of the invention. Also, other adjustment attachment, such as wing nut connectors may be employed for the adjustment fasten suction cups without departing from the scope of the invention. In addition, one or more fixed suction cups may be employed, in lieu of the described adjustable suction cups, on the hand graspable portions of the various handle embodiments for releasable attachment thereof to fixed surfaces, as so desired.

Further, in the illustrated embodiments, the hand graspable portion of the suction handle is shown having smooth surfaces but it is also considered within the scope of the invention to employ finger and/or thumb depressions on the handle surfaces, when so desired. Suitable advertising indicia including, but not limited to, trade names, may also be added to any of the surfaces of the portable handles of the present invention, as so desired.

Accordingly, it is therefore to be understood that, within the scope of the appended claims, the invention may be practiced other than as specifically described herein.

What is claimed as new and desired to be secured by Letters Patent of the United States is:

1. A portable handle for converting a beverage container into a drinking mug comprising:

an elongated support shaft having first and second end portions;

a hand graspable handle having end portions thereof integral with the respective first and second end portions, and on a first side of, said elongated support shaft;

said hand graspable handle having an intermediate portion integral with said end portion thereof and spaced from said elongated support shaft;

suction attachment means for releasably retaining a beverage can disposed on a second side of said elongated support shaft;

said suction attachment means for releasably retaining a beverage can including at least one suction cup;

said at least one suction cup having a base end secured to said second side of said elongated support shaft and having an exposed suction cup surface extending from said base end;

said hand graspable handle being provided with a suction cup support groove extending over at least a portion of the length and through at least a portion of the thickness thereof;

an additional suction cup slidably positioned on said hand graspable handle;

said additional suction cup having a threaded bolt connected thereto and extending into said suction cup support groove;

said threaded bolt and said additional suction cup being movable along said suction cup support groove from a position parallel with said elongated support shaft to a position perpendicular to said elongated support shaft; and means for adjustably securing said additional suction cup at any point along the length of said suction cup support groove.

2. The portable handle of claim 1 wherein:

said means for adjustably securing said additional suction cup at any point along the length of said suction cup support groove includes an enlarged cavity disposed along the length of said suction cup support groove;

said threaded bolt being secured to and rotatable with said additional suction cup;

a nut for threadingly receiving said threaded bolt;

said nut being slidably retained in a non-rotatable position within said enlarged cavity of said suction cup support groove; whereby, when said threaded bolt of said additional suction cup is tightly secured within said nut, the frictional forces exerted thereon prevent said additional suction cup from sliding along said suction cup support groove and, when said threaded extension of said additional suction cup is loosely received by said nut, said nut is freely movable along the length of said suction support groove to permit positioning of said additional suction cup at any point along the length of said suction cup support groove.

3. A portable handle for a beverage can comprising:

a hand graspable handle having a length substantially equal to the height of a conventional beverage can;

a first suction cup serving to releasably connect said hand graspable handle to a beverage can;

said hand graspable handle being provided with a suction cup support groove extending over at least a portion of the length and through at least a portion of the thickness thereof:

an additional suction cup slidably positioned on said hand graspable handle;

said additional suction cup serving to provide releasable attachment of said portable handle and any attached beverage can to a solid surface;

said additional suction cup also having a threaded bolt connected thereto and extending into said suction cup support groove;

said suction support groove including an enlarged cavity disposed along the entire length thereof;

a nut for threadingly receiving said threaded bolt;

said nut being slidably retained in a non-rotatable position within said enlarged cavity of said suction cup support groove;

said threaded bolt, nut and said additional suction cup, being movable along said suction cup support groove for adjusting said additional suction cup to permit attachment thereto with horizontal and vertically disposed solid surfaces.

4. A portable handle for a beverage can comprising:

a hand graspable handle a length substantially equal to the height of a conventional beverage can;

a first suction cup serving to releasably connect said hand graspable handle to a beverage can;

said hand graspable handle being provided with a suction cup support groove extending through and over a portion of the length thereof;

an additional suction cup slidable positioned on said hand graspable handle;

said additional suction cup serving to provide releasable attachment of said portable handle and any attached beverage can to a solid surface;

said additional suction cup also having a threaded bolt threadingly connected thereto and extending through said suction cup support groove;

a knurled head provided on said threaded bolt; whereby, when said knurled head of said threaded bolt is turned to tighten said threaded bolt within said additional suction cup, the frictional forces exerted thereon will prevent said additional suction cup from sliding along said suction cup support groove and, when said threaded bolt of said additional suction cup is loosely received by said additional suction cup, said suction cup is freely movable along the length of said suction cup support groove to permit positioning of said additional suction cup at any desired point along the length of said suction cup support groove.

5. A portable handle for a beverage can comprising:

a hand graspable handle having a length substantially equal to the height of a conventional beverage can;

suction cup means serving to releasably connect said hand graspable handle to a beverage can;

said hand graspable handle terminating in a pair of parallel ends and said suction cup means including at least one suction cup attached to each member of said pair of parallel ends;

said hand graspable handle being provided with a suction cup support groove extending over at least a portion of the length and through at least a portion of the thickness thereof;

an additional suction cup slidably positioned on said hand graspable handle;

said additional suction cup having a threaded bolt connected thereto and extending into said suction cup support groove;

said threaded bolt and said additional suction cup being movable along said suction cup support groove from a position parallel with a beverage can attached to said portable handle to a position perpendicular to a beverage can attached to said portable handle; and means for adjustably securing said additional suction cup at any point along the length of said suction cup support groove.

* * * * *